US007793796B1

(12) United States Patent
Evans

(10) Patent No.: US 7,793,796 B1
(45) Date of Patent: Sep. 14, 2010

(54) HAIR ACCESSORIES STORAGE AND DISPENSING DEVICE

(76) Inventor: Constance Evans, 1836 S. 49th Ct., Cicero, IL (US) 60804

( * ) Notice: Subject to any disclaimer, the term of this patent is extended or adjusted under 35 U.S.C. 154(b) by 153 days.

(21) Appl. No.: 12/077,845

(22) Filed: Apr. 30, 2008

(51) Int. Cl.
*B65H 1/00* (2006.01)
*B65G 59/00* (2006.01)

(52) U.S. Cl. ..... 221/113; 221/208; 221/277

(58) Field of Classification Search ..... 221/25, 221/67–69, 89, 91, 92, 119–127, 130–133, 221/154, 155, 175, 176, 178, 179, 181, 183, 221/184, 191, 193–196, 208, 209, 246, 247, 221/263, 266, 268, 272, 281, 303, 306, 312 C
See application file for complete search history.

(56) References Cited

U.S. PATENT DOCUMENTS

| | | | | | |
|---|---|---|---|---|---|
| 1,562,152 | A | * | 11/1925 | Du Grenier | 221/263 |
| 1,729,287 | A | * | 9/1929 | Giltner | 222/144 |
| 2,268,688 | A | * | 1/1942 | Andrews | 221/119 |
| 2,275,985 | A | * | 3/1942 | Prins | 194/255 |
| 3,055,559 | A | * | 9/1962 | Allison | 222/242 |
| 3,242,931 | A | * | 3/1966 | Wandrey | 453/29 |
| 3,410,385 | A | * | 11/1968 | Freet et al. | 194/232 |
| 3,733,112 | A | * | 5/1973 | Marquardt | 312/97.1 |
| 3,863,804 | A | * | 2/1975 | Infante-Diaz et al. | 221/251 |
| 3,948,416 | A | * | 4/1976 | Housman | 221/121 |
| 4,055,194 | A | | 10/1977 | Martinez | |
| 4,078,661 | A | | 3/1978 | Thomas | |
| 4,109,825 | A | * | 8/1978 | Weitzman | 221/14 |
| 4,117,956 | A | * | 10/1978 | von Schuckmann | 221/288 |
| 4,124,144 | A | * | 11/1978 | Radek | 221/191 |
| 4,150,766 | A | * | 4/1979 | Westendorf et al. | 221/112 |
| D274,040 | S | * | 5/1984 | Ridgley | D3/203.3 |
| 4,635,817 | A | * | 1/1987 | Kostov | 221/89 |
| 4,667,959 | A | * | 5/1987 | Pfeiffer et al. | 273/149 R |
| 4,782,980 | A | * | 11/1988 | Heimlich et al. | 221/265 |
| 5,000,343 | A | * | 3/1991 | Allen | 221/82 |
| 5,078,097 | A | * | 1/1992 | Chisholm | 119/51.13 |
| 5,520,307 | A | * | 5/1996 | Miller et al. | 221/2 |
| 5,634,569 | A | * | 6/1997 | DeCoster | 220/735 |
| 5,878,593 | A | * | 3/1999 | Lane et al. | 62/457.5 |
| 5,947,329 | A | * | 9/1999 | Bailey | 221/288 |
| 6,343,845 | B1 | | 2/2002 | Woodard | |
| 6,571,951 | B2 | | 6/2003 | Levine et al. | |
| 6,918,509 | B2 | | 7/2005 | Baker et al. | |
| 7,410,077 | B2 | * | 8/2008 | Ness | 221/120 |
| 2003/0089731 | A1 | * | 5/2003 | Mayer et al. | 221/279 |

(Continued)

*Primary Examiner*—Gene Crawford
*Assistant Examiner*—Kelvin L Randall, Jr.
(74) *Attorney, Agent, or Firm*—Philip H. Kier

(57) ABSTRACT

A device for storing and dispensing hair accessories having a cylinder with a plurality of compartments formed by the cylinder and elongated, curved elements attached to the cylinder. The curved element extend beyond the bottom of the cylinder and sit on a base with a short vertical wall with a release slot in it. The cylinder contains a shaft with blades attached to it. The blades fit within the interstices of the compartments. When the shaft is rotated, the blades force the cylinder to rotate. When the shaft is rotated such that a compartment containing items aligns with the release slot in the wall of the base, an item will be dispensed through the release slot in the wall. The device may also have a carrying handle, lock ears for holding the lid and shaft together, and a screw for holding the shaft and base together.

11 Claims, 1 Drawing Sheet

U.S. PATENT DOCUMENTS

Figure 1:
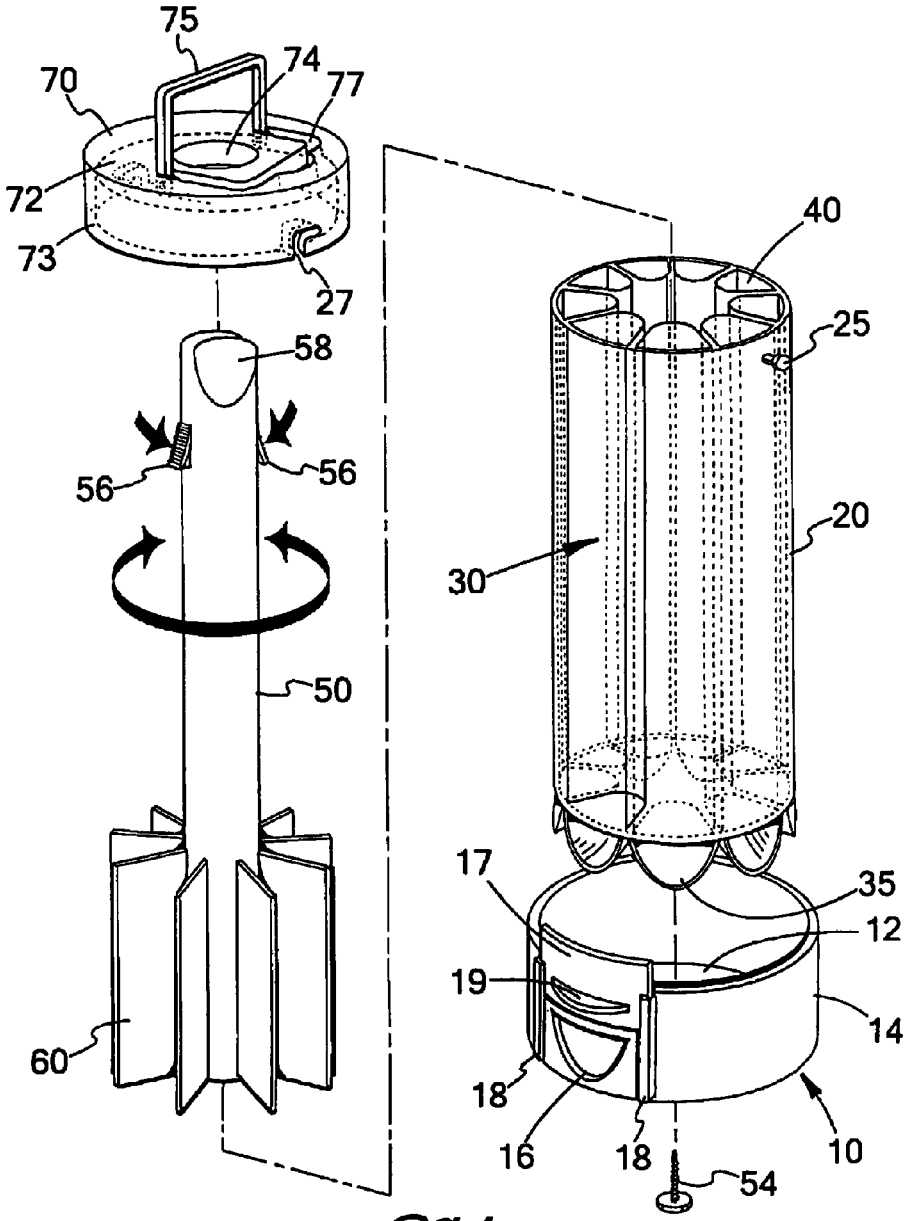

2003/0234195 A1* 12/2003 Earl et al. ..... 206/338
2008/0308570 A1* 12/2008 Brandt et al. ..... 221/22
2009/0008274 A1* 1/2009 Bertin ..... 206/223

* cited by examiner

HAIR ACCESSORIES STORAGE AND DISPENSING DEVICE

BACKGROUND OF THE INVENTION

This invention pertains to a device for storing and dispensing hair accessories. More particularly, it pertains to apparatus that dispenses hair accessories such as barrettes and bolos in a way that keeps them from becoming tangled.

Many women have a number of several kinds of hair accessories especially those accessories that are made in a profusion of colors, such as barrettes and bolos. When these kinds of accessories are mixed together in the same container, they usually become tangled, and time and effort are wasted untangling them. This problem can be alleviated by storing these accessories in a storage container that has compartments to which items can be loaded singly and from which items can be dispensed singly. The device should allow a user to select which compartment the item is loaded into or dispensed from.

Relevant prior art includes the following patents. Martinez in U.S. Pat. No. 4,055,194 teaches the use of mated channels and track rollers in chutes for dispensing hairdresser supplies into selected compartments. Thomas in U.S. Pat. No. 4,078,661 teaches storing and dispensing pills from the compartmentalized circumference of a circular base to which a rotating cover is attached. Baker et al in U.S. Pat. No. 6,918,509 teaches dispensing candy and other small objects from a dispenser having a rotatable hopper.

SUMMARY OF THE INVENTION

The instant invention has a cylinder with a plurality of compartments formed by the cylinder and elongated, curved elements attached to the cylinder. The elongated elements extend beyond the bottom of the cylinder and sit on a base with a vertical wall with a release slot in it. The cylinder contains a shaft with blades attached to it. The blades fit within the interstices of the compartments. When the shaft is rotated, the blades force the cylinder to rotate. When the shaft is rotated such that a compartment containing items aligns with the release slot in the wall of the base, an item will be dispensed through the hole in the wall.

BRIEF DESCRIPTION OF THE SEVERAL VIEWS

FIG. 1 is an exploded view of the invention.

DETAILED DESCRIPTION OF THE INVENTION

With reference to the FIGURE, the device has a base 10 with a circular horizontal section 12 and a vertical wall 14 that has a release slot 16 large enough for hair accessory items to be dispensed through it. The device also has a circular cylinder 20 preferably made of a transparent material such as plastic or glass. The outer diameter of the cylinder is smaller than inner diameter of the vertical wall of the base. Integrally attached to the cylinder are a plurality of elongated elements 30 that have a semi-circular or near semi-circular cross section. The elongated elements as attached to the cylinder form a plurality of compartments 40 in which hair accessory items can be stored. The elongated elements 30 are longer than the cylinder 20. The tops of the elongated elements are aligned with the top of the cylinder. Consequently, the bottoms of the elongated elements, but not the cylinder are in contact with horizontal section 12 of the base 10 and there is room for an item to pass below the bottom of the cylinder and be dispensed through the release slot 16 in the vertical wall 14 of the base. To facilitate discharge of an item from a compartment when aligned with the release slot, section 35 of the elongated elements below the cylinder may be curved outward to act as a chute to encourage an accessory to slide out of a compartment and through the release slot. There may also be a door 17 that can cover the release slot 16 to prevent inadvertent release of items. This door preferably moves up and down on vertical tracks 18 and may have a handle 19.

The cylinder also contains a shaft 50 with a plurality of blades 60 that are integrally attached to the shaft. Preferably, the number of blades is equal to the number of compartments, although there could be fewer blades. The blades fit within interstices between compartments. When the shaft is rotated, the blades contact the elongated elements, and thus force the compartments and hence the cylinder to rotate. A user would rotate the shaft until a compartment with the item that the user wants dispensed to align with the release slot in the base. The device could also have a lid 70 with a horizontal section 72 and a lateral section 73. The horizontal section would have a hole 74 so that shaft 50 would extend above the lid so that the lid could remain on the cylinder when the shaft is rotated. The lid could also have a carrying handle 75 that can rotate from a vertical position for carrying to a horizontal position when the shaft is being rotated. It is preferred that the carrying top of lid have a recess 77 into which the carrying handle can be rotated.

There should be means to allow the device to hold together when being moved from place to place by grasping handle 75. It is preferred that these means are a screw 54 that passes through horizontal section 12 of the base 10 and is loosely screwed into shaft, two bayonet catches 25 high on the cylinder 20 and on opposite sides of the cylinder, two bayonet slots 27 on opposite sides of the lateral section of the lid 70, and two lock ears 56 high up on the shaft 50. The screw causes the base to be attached to the shaft, but because the screw is loosely screwed into the shaft, the shaft can still rotated while the base remains stationary. To lock the lid to the shaft, the lid is placed on the shaft and pushed down compressing the lock ears until the lock ears extend above the top of the lid. To lock the cylinder 20 to the lid, the cylinder is rotated until its bayonet ear catches are engaged with the bayonet slots on the lid. When the lid 70 is lifted by the carrying handle 75, the shaft 50 is also lifted because of contact of the shaft's lock ears with the lid. The shaft being attached to the base 10 by means of screw 54, the base is also lifted. As cylinder 20 and elongated elements 30 fit within the base, they are also lifted. The bayonet catches and bayonet slots provide a secondary means of attaching the cylinder to the lid. To separate the shaft and the lid, for example to place hair accessories in compartments 40, a user presses on the lock ears 56 to release them. To separate the lid from the cylinder, the lid is rotated until the bayonet catch 25 disengages from the bayonet slot 27. To facilitate rotation of the shaft 40, its top may have opposing bevels 58.

The instant invention could be used as follows. To store hair accessories, the lid is removed by pressing on the lock ears and rotating the lid to release bayonet catches. Then accessories are placed in one or more compartments. To dispense an accessory, the part of the shaft extending above the cover is rotated until the compartment with the accessory to be dispensed aligns with the release slot in the base. Then the door covering the release slot is slid up to allow an accessory to exit the release slot.

I claim:

1. A device for storing and dispensing hair accessories comprising:

a base with a circular horizontal section and a vertical wall, the wall having a release slot in it;

a vertical circular cylinder with a diameter allowing it to fit within the base;

a plurality of elongated elements of quasi semicircular cross section longer than the cylinder and with each having a section extending below the cylinder, the elongated elements being integrally attached to the cylinder and being inside the cylinder;

a shaft with a plurality of blades, the blades fitting in interstices between elongated elements; and a screw for loosely attaching the base to the shaft.

2. A device for storing and dispensing hair accessories as set forth in claim 1 wherein the cylinder and elongated elements are transparent.

3. A device for storing and dispensing hair accessories as set forth in claim 2 further comprising a lid with a horizontal section having a central hole and a lateral section integrally attached to the horizontal section, and also the shaft having lock ears for attaching the lid to the shaft.

4. A device for storing and dispensing hair accessories as set forth in claim 3 further comprising a carrying handle on the lid.

5. A device for storing and dispensing hair accessories as set forth in claim 4 wherein the section of the elongated elements extending below the cylinder is curved outward.

6. A device for storing and dispensing hair accessories as set forth in claim 5 wherein the means for loosely attaching the base to the shaft is a screw passing through the circular horizontal section of the base and loosely penetrating the shaft.

7. A device for storing and dispensing hair accessories as set forth in claim 6 wherein the means for attaching the shaft to the lid are lock ears high on the shaft.

8. A device for storing and dispensing hair accessories as set forth in claim 7 further comprising a door for covering the release slot.

9. A device for storing and dispensing hair accessories as set forth in claim 8 wherein the door moves up and down on vertical tracks.

10. A device for storing and dispensing hair accessories as set forth in claim 9 wherein the cylinder is attached to the lid with bayonet catches high up on the cylinder and bayonet slots on the lateral section of the lid.

11. A device for storing and dispensing hair accessories as set forth in claim 10 further comprising bevels in the shaft's top.

* * * * *